US009909263B2

(12) United States Patent
Rada

(10) Patent No.: US 9,909,263 B2
(45) Date of Patent: Mar. 6, 2018

(54) METHOD FOR GUIDING A DEVICE FOR INSERTING ELEMENTS INTO THE GROUND FOR THE BUILDING OF A STRUCTURE; INSERTION DEVICE AND ASSOCIATED VEHICLE

(71) Applicant: ALSTOM TRANSPORT TECHNOLOGIES, Saint-Ouen (FR)

(72) Inventor: Nicolas Rada, Neuilly S/Seine (FR)

(73) Assignee: Alstom Transport Technologies, Saint-Ouen (FR)

( * ) Notice: Subject to any disclaimer, the term of this patent is extended or adjusted under 35 U.S.C. 154(b) by 210 days.

(21) Appl. No.: 14/937,720

(22) Filed: Nov. 10, 2015

(65) Prior Publication Data

US 2016/0130767 A1 May 12, 2016

(30) Foreign Application Priority Data

Nov. 10, 2014 (FR) ..... 14 60850

(51) Int. Cl.

| | |
|---|---|
| ***E01B 35/00*** | (2006.01) |
| ***G01C 15/00*** | (2006.01) |
| ***G01C 15/02*** | (2006.01) |
| ***E01B 29/32*** | (2006.01) |
| ***E01B 1/00*** | (2006.01) |

(Continued)

(52) U.S. Cl.

CPC ..... *E01B 29/32* (2013.01); *E01B 1/004* (2013.01); *E01B 35/04* (2013.01); *E01C 19/004* (2013.01); *E01B 2203/16* (2013.01)

(58) Field of Classification Search

None

See application file for complete search history.

(56) References Cited

U.S. PATENT DOCUMENTS 5,157,840 A * 10/1992 Henttinen ..... E01B 35/04 104/7.2
5,331,745 A * 7/1994 Jager ..... E01B 35/00 180/169

(Continued)

FOREIGN PATENT DOCUMENTS

| | | |
|---|---|---|
| DE | 4038860 A1 | 6/1992 |
| EP | 1178153 A1 | 2/2002 |

OTHER PUBLICATIONS

Search Report dated Jul. 15, 2015 in FR application No. 1460850.

*Primary Examiner* — Navid Ziaeianmehdizadeh
(74) *Attorney, Agent, or Firm* — Knobbe, Martens, Olson & Bear, LLP

(57) ABSTRACT

A method includes: taking a topographical survey of a plurality of geographical points near a structure to be built, the position of each point being determined in an absolute frame of reference XYZ; installing a plurality of reflectors, each reflector being placed at a geographical point of the topographical survey; measuring distances between reflectors and optical devices, using at least three optical devices fixed on a moving arm of an insertion device that bears an element to be inserted; computing, by trilateration, the absolute position of the arm of the insertion device from the measured distances and from the known position of each optical reflector; and moving the arm of the insertion device based on the computed absolute position, so as to bring the element to be inserted into a predetermined implantation position.

12 Claims, 1 Drawing Sheet

(51) Int. Cl.
*E01B 35/04* (2006.01)
*E01C 19/00* (2006.01)

(56) References Cited

U.S. PATENT DOCUMENTS

2002/0014015 A1* 2/2002 Robertson ..... E01B 1/004 33/1 G
2003/0097235 A1* 5/2003 Theurer ..... G01S 17/88 702/150
2003/0102586 A1* 6/2003 Sayadi ..... E01B 1/002 264/35
2004/0223139 A1* 11/2004 Vogel ..... G01S 5/163 356/141.1
2006/0198700 A1* 9/2006 Maier ..... E01C 19/004 404/84.1
2007/0201161 A1* 8/2007 Milesi ..... E01B 29/32 360/77.08
2007/0251107 A1* 11/2007 Milesi ..... E01B 1/004 33/1 G
2008/0229592 A1* 9/2008 Hinderling ..... G01C 15/002 33/293
2009/0235543 A1* 9/2009 Hayashi ..... G01C 3/02 33/293
2010/0215433 A1* 8/2010 Fritz ..... E01C 19/006 404/84.5
2012/0008136 A1* 1/2012 Jaeger ..... G01C 1/02 356/138
2012/0240809 A1* 9/2012 Aguirre Fernandez ..... E01B 29/005 104/3
2013/0230212 A1* 9/2013 Landes ..... G06K 9/00791 382/104
2014/0074295 A1* 3/2014 Kumagai ..... E01C 19/006 700/275
2014/0074361 A1* 3/2014 O'Connor ..... G05D 1/0236 701/50
2014/0232859 A1* 8/2014 Kotzur ..... G01C 1/04 348/135
2015/0153158 A1* 6/2015 Tsao ..... G01C 3/08 356/634
2016/0069671 A1* 3/2016 Dokter ..... E01C 19/006 356/138

* cited by examiner

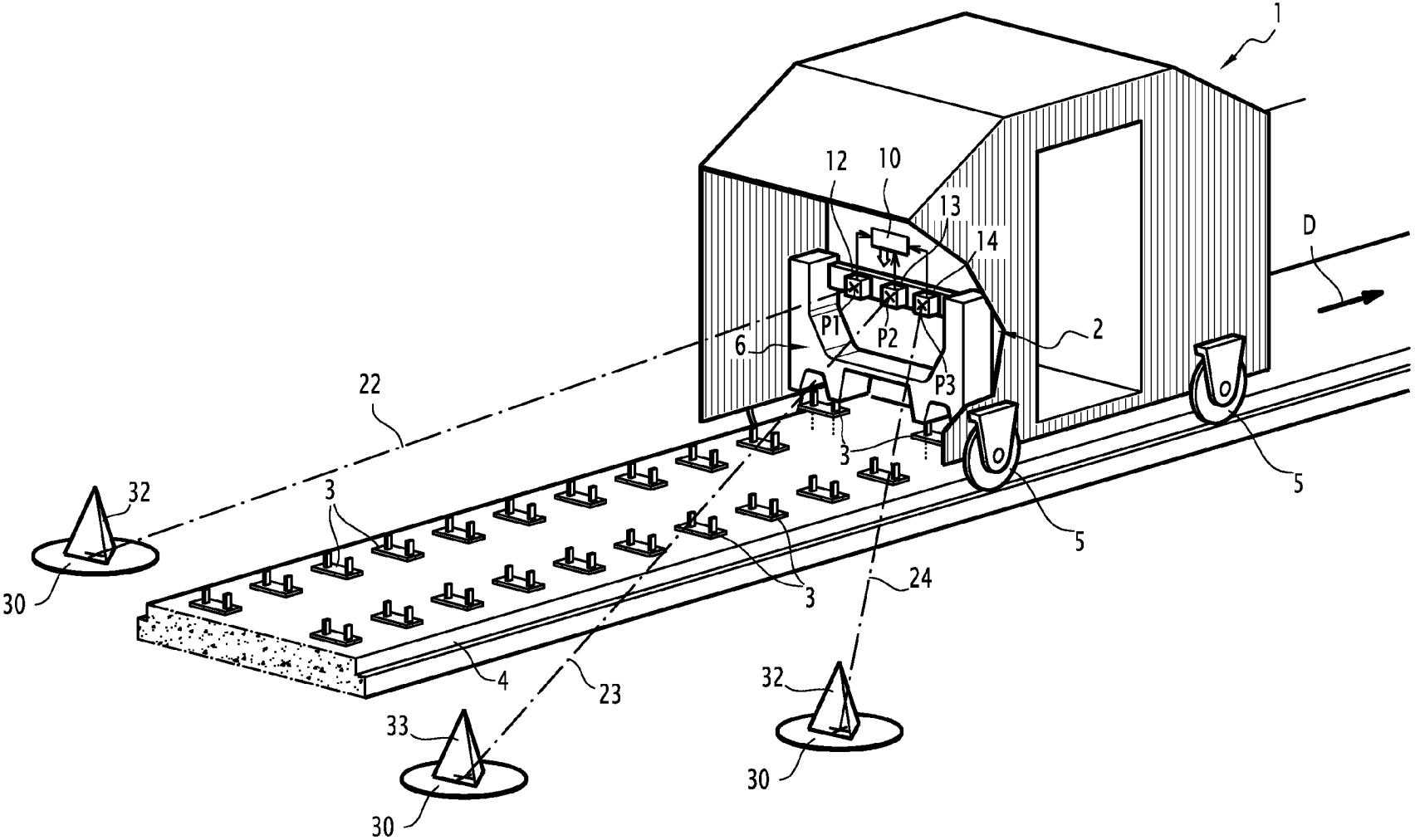
1
D
5
5
2
14
13
10
12
P3
P2
P1
6
3
3
3
24
23
22
4
32
30
33
30
32
30

METHOD FOR GUIDING A DEVICE FOR INSERTING ELEMENTS INTO THE GROUND FOR THE BUILDING OF A STRUCTURE; INSERTION DEVICE AND ASSOCIATED VEHICLE

This application claims priority to French Patent Application No. 14 60850, filed Nov. 10, 2014, the disclosure of which, including the specification, the drawings, and the claims, is hereby incorporated by reference in its entirety.

The invention relates to a method for guiding a device for inserting elements into the ground for the building of a structure. More particularly, the invention relates to a method for guiding a device for inserting tie plates into the ground for the building of a railroad track. The invention also relates to a system allowing the implementation of such a guide method.

Known, for example from document EP 0,803,609, is a device for inserting tie rods into concrete, making it possible to produce a railroad track quickly. In order to be effective, however, such a tie rod insertion device requires that it be positioned very precisely, so that the implantation position of each tie rod is precise to within a millimeter.

Document FR 2,812,671 discloses a guide method for guiding such an insertion device.

To that end, the moving arm of the insertion device, which makes it possible to bring the tie rod into a predetermined position and implantation orientation, then to implant the tie rod in the concrete, is provided with a first prism and a second prism. Each prism is able to reflect a beam of laser light emitted by a remote total measurement station, placed along the railroad track to be built.

The guide method then consists of installing a total measurement station near the railroad track to be built and determining the coordinates of the geographical installation point of the total measurement station. These coordinates are absolute in that they are given relative to an absolute frame of reference XYZ.

A total measurement station includes an optical device able to emit a laser beam toward reflective target. From the reflected beam, the total measurement station is able to determine the distance between the total measurement station and the target, as well as the angle formed by the direction between the total measurement station and the target, with a reference plane, which is a horizontal plane passing through the optical device.

Then, during each implantation cycle of a tie rod, the absolute position of the arm is determined periodically. Within the meaning of the present patent application, "positioning" refers both to the position of a point of reference of that object (three coordinates), and the orientation of a reference segment of that object (three angles).

Thus, the absolute positioning of the arm, i.e., the positioning in the absolute frame of reference XYZ, is for example given by the position of the first prism, as a reference point, and the orientation of the segment between the first prism and the second prism, as a reference segment.

Thus, in order to determine the absolute positioning of the arm, the method consists of manually orienting the total measurement station so that its laser beam points toward the first prism and measuring the distance of the angle between the total measurement station and that first prism, then manually orienting the total measurement station so that its laser beam points toward the second prism and measuring the distance and the angle between the total measurement station and that second prism.

These measurements, as well as the absolute position of the total measurement station, are sent to a computer of the implantation device, which computes the absolute position of the arm. This information makes it possible to control the movement of the arm of the insertion device to bring the tie rod, to within an uncertainty, into the absolute position and implantation orientation, as defined by a theoretical building plan of the railroad track.

Such a guide method remains difficult to implement. Indeed, over the 90 seconds an implantation cycle of a tie rod takes, 30 seconds correspond to the implantation strictly speaking of the tie rod in the fresh concrete of the railroad track, while the other 60 seconds are dedicated to a single determination of the absolute positioning of the arm. In other words, if the positioning of the tie rod before implantation is not in the required allowance interval, it is necessary to repeat the step for determining the absolute position of the arm.

During the determination of the position of the arm, half of the time is used to orient the laser beam first toward the first prism, then toward the second prism. This is not practical and increases the risk of error. Furthermore, in the environment of the structure, the presence of an operator in the immediate vicinity of the structure remains bothersome and presents risks in terms of personnel safety.

From an operational standpoint, it is necessary for a target prism to be in direct sight of the total measurement station. However, on a worksite, many risks exist that the laser beam between the station and prism will be concealed, if only by the passage of personnel around the insertion device.

Lastly, the optical device of a total measurement station only has a range of approximately 100 meters. It is therefore necessary to move the total measurement station over the course of the movement of the vehicle 1 and the advancement of the building of the railroad track. Upon each movement of the total measurement station, the installation step of the total measurement station and the determination of the absolute position should be done again, before sending that information to the onboard computer so that a new set of tie rod installation cycles can begin.

It should be emphasized that the implantation step of a total measurement station is not easy. Indeed, it is necessary for the optical device to be very precisely placed in a horizontal plane. If that is not the case, the optical device does not work and the total measurement station delivers erroneous measurements.

It can take up to 20 minutes to install and determine the new position of the total measurement station.

The invention therefore aims to resolve these problems.

To that end, the invention relates to a method for guiding a device for inserting elements into the ground to for the building of a structure, characterized in that it comprises the following steps: taking a topographical survey of a plurality of geographical points near the structure to be built, the position of each point being determined in an absolute frame of reference XYZ; installing a plurality of reflectors, each reflector being placed at a geographical point of the topographical survey; measuring, using at least three optical devices, fixed on a moving arm of the insertion device that bears the element to be inserted, distances between reflectors and optical devices; computing, by trilateration, the absolute position of the arm of the insertion device from measured distances and from the known position of each optical reflector; and moving the arm of the insertion device based on the computed absolute position, so as to bring the element to be inserted into a predetermined implantation position.

According to specific embodiments, the method includes one or more of the following features, considered alone or according to all technically possible combinations:

- each optical device is able to track a reflector placed in the environment of the insertion device, the corresponding optical device being able to measure the distance between its fixation point on the arm of the insertion device and the reflector associated with it;
- an optical device having a limited range, over the course of the advancement of the structure, new reflectors are installed and associated with each optical device with which the insertion device is provided;
- the actuation of the arm of the insertion device is done by actuators, controlled by an onboard automaton, which in turn is controlled by a computer, the computer computing the absolute position of the arm from data sent to it, at each moment, by the optical devices with which the insertion device is equipped;
- the arm is motorized in translation and rotation along three axes orthogonal to one another, the movement of the arm being controlled by the automaton so as to bring the element to be implanted into the absolute implantation position from the absolute position of the arm that is sent to it by the computer;
- the structure to be built being a railroad track, the element to be inserted is a tie rod designed to support a rail, the tie rod being inserted into a concrete slab that is not yet hardened.

The invention also relates to an insertion device for inserting an element into the ground, designed to be guided by the implementation of a guide method according to the preceding method, including an arm, translatable and rotatable along three axes orthogonal to one another bearing the element to be inserted into the ground, actuators of said arm, an automaton for controlling said actuators and a computer for commanding said automaton, characterized in that it includes at least three optical devices, fixed on the arm of the insertion device, each optical device being able to measure a distance between its fixationpoint on the arm and a remote optical reflector placed in the environment of the structure to be built, in a known installation position, and in that said computer is programmed to compute an absolute position of said arm, by implementing a trilateration algorithm, from measurements sent by the optical devices and the known positions of the optical reflectors.

According to specific embodiments, the device includes one or more of the following features, considered alone or according to all technically possible combinations:

- each optical device is able to track a target, so as to be able to associate each optical device with an optical reflector of the environment.
- the element is a tie rod designed to support a railroad rail, the tie rod being inserted into a concrete slab that is not yet hardened.

The invention also relates to a vehicle, characterized in that it includes an insertion device according to the preceding device.

The invention will be better understood upon reading the following description of one particular embodiment, provided solely as a non-limiting example, and done in reference to the appended drawing, which diagrammatically shows a system for implementing the method for guiding a device for inserting elements into the ground according to the invention.

The FIGURE shows a vehicle 1 equipped with a device 2 for inserting elements into the ground to build a structure. In the present case, the work is a portion of railroad track, for example for a tram, metro or long-distance line. The elements to be inserted are then tie rods 3, sealed in the concrete of the apron 4 of the track and designed to maintain rails.

The tie rods 3 are of the traditional type and respectively include a plate made from rigid material, such as cast iron, and two anchors. The tie rods 3 are kept in the concrete slab once the latter has hardened. They each have a device making it possible to fasten a rail.

The vehicle 1 is mounted on four wheels 5, two of which are guide wheels and the other two of which are drive wheels. It includes propulsion and steering means (not shown in the FIGURE) making it possible to move the vehicle 1 in a given direction, essentially the direction D of the track to be built.

The vehicle 1 is placed above the apron 4, whereof the concrete, which has just poured, has not yet hardened.

The insertion device 2 includes an arm 6 mounted at the rear of the vehicle 1. Alternatively, the insertion device includes several arms.

The arm 6 includes, on its lower part, gripping systems at the end of which two tie rods 2 are placed designed to be inserted in the concrete of the apron 4 freshly poured, each tie rod corresponding to a line of railroad tracks.

The arm 6 of the insertion device is movable. It is moved, in translation along three axes and in rotation along three axes, relative to a chassis of the vehicle 1, by a set of actuators (not shown in the FIGURE).

These actuators are controlled by an onboard automaton (not shown in the FIGURE), which in turn is controlled by an onboard computer 10.

The computer 10 in particular computes the absolute position of the arm 6, i.e., the absolute position of a reference point P of the arm and the absolute orientation of a reference segment A associated with the arm 6. For example, a reference segment is parallel to the central part of the arm with an "H" shape and coming from the reference point P.

Depending on the absolute position of the arm 6 and an absolute implantation position of a tie rod 3 (i.e., an absolute implantation position of the tie rod and an absolute implantation orientation of that tie rod), the automaton actuates the propulsion and steering means of the vehicle 1 to come closer to the absolute implantation position, then actuates the movement of the arm 6 to bring the tie rod into the absolute implantation position (to within an uncertainty). Once the tie rod is in that position, the automaton is able to actuate the jacks so as to insert the two tie rods into the fresh concrete, then to release the implanted jacks to command the jacks and the arm to return to the idle position for a subsequent cycle.

For guiding of the insertion device 2, the arm 6 bears three optical devices 12, 13 and 14. The first optical device 12 is fixed at a point P1, the second optical device 13 is fixed at a point P2 and the third optical device 14 is fixed at a point P3 of the arm. The fixation points are determined by construction with the arm with high precision. In particular, the segments separating each pair of points are known with great precision.

Each optical device is equipped with an emitting optic able to emit a laser beam 22, 23, 24. Each optical device is equipped with a receiving optic making it possible to collect the beam reflected by a target. From the time of flight separating the emission from the reception of a laser pulse, an optical device is able to determine a distance between the fixation point of the laser device and the target.

The operating frequency of an optical device is high: between 200 and 100 Hz.

In order to implement the guide method, a plurality of reflective prisms, such as the prisms 32, 33, 34, are positioned in the environment. A prism is able to reflect the laser beam emitted by an optical device, such as the devices 12, 13, 14.

The prisms are placed in geographical points of a topographical survey. Thus, the absolute position of each prism is known. The qualification "absolute" refers to information relative to an absolute frame of reference XYZ.

Each optical device 12, 13, 14 of the insertion device 2 is able to track a particular target. For example, the first device 12 tracks the prism 32, the second device 23 tracks the prism 33 and third device 14 tracks the prism 34. To that end, each optical device 12, 13, 14 is equipped with motor means and a target tracking system.

The distance between the fixation point of a device and the prism that it tracks is delivered at each moment by the optical device and transmitted to the onboard computer 10.

It should be noted that an optical device only having a range of approximately 100 meters, it is necessary to associate, with the optical device equipping the arm 6, new prisms for the environment over the course of the movement of the vehicle 1 and the advancement of the railroad track.

The method for guiding the insertion of a pair of tie rods 3 by the device 2 will now be described in detail.

Prior to building the railroad track, a topographical survey is done making it possible to define the absolute position of a plurality of geographical points successively situated along the profile of the railroad track to be built.

In light of the range of the optical devices 12, 13, 14, these geographical points are distributed at intervals of approximately 50 m to 100 m. They are marked by terminals 30 placed stably along the track to be built.

In order to build a portion of the railroad track, the vehicle 1 is moved above the portion of the apron 4 whereof the concrete, which has just been poured, has not yet hardened.

Prisms are then placed precisely on terminals 30 that are visible and within range of the optical devices 12, 13, 14 onboard the vehicle 1. The prisms 32, 33 and 34 are thus positioned.

The optical devices 12, 13 and 14 are next configured to track the prisms 32, 33 and 34, respectively. The identifier of the prism tracked by an optical device is entered into the computer 10. From that identifier, by consulting a database of the geographical points of the topographical survey stored by the computer 10, the latter knows the absolute position of each of the prisms 32, 33, 34.

Then, an implantation cycle of two tie rods 3 is done by the insertion device 2 as follows.

At each moment of the cycle, each optical device delivers, to the computer 10, the instantaneous distance between the fixation point of that device on the arm 6, and the prism that said device is tracking. Thus, at each moment, the computer 10 receives:

- from the first optical device 12, a first distance d1 between the point P1 and the prism 32.
- from the second optical device 13, a second distance d2 between the point P2 and the prism 33.
- from the third optical device 14, a third distance d3 between the point P3 and the prism 34.

Owing to these instantaneous distance measurements, and the absolute position of each prism, the computer 10 then computes the absolute position of the arm 6 in the absolute reference XYZ.

The computation done by the computer 10 is of the trilateration type. Trilateration is a mathematical method making it possible to determine the position of a point, in the case at hand each point P1, P2 and P3, by using the geometry of the triangles, just like triangulation. However, unlike triangulation, which uses both angles and distances to determine the position of the point, trilateration only uses distances.

In order to determine the absolute position of the arm (six degrees of freedom), it is necessary for the insertion device to include at least three optical devices, also knowing the geometry of the fixation of these devices (vectors P1 P2 and P1 P3, for example).

This absolute position of the arm 6 is sent by the computer 10 to the automaton.

Based on the absolute implantation position of each tie rod, mentioned in a database stored in the memory of the automaton, the latter commands the movement of the vehicle 1 to bring the arm 6 into an idle position relative to the chassis of the vehicle 1, substantially overhanging the implantation position of the tie rods 3.

Once the vehicle 1 is stopped in this position, the automaton commands the actuators of the arm 6 to bring, to within an uncertainty, the tie rods 3 carried by the arm 6 into the absolute implantation position of each tie rod.

Once in this position, the automaton then commands the jacks of the arm 6 to insert the tie rods 2 into the concrete of the apron 4.

Once the two tie rods 2 are inserted, the automaton commands the release by the arm 6 of the tie rods 3 and returns the arm to its idle position relative to the chassis of the vehicle 1.

Two new tie rods are then placed at the ends of the jacks of the arm 6 and the following implantation cycle of these two new tie rods is carried out.

The tie rods of the portion of the railroad track are gradually implanted.

Such a guide method has the advantage of being very fast, since, during a tie rod implantation cycle, the optical devices work automatically and continuously track the prism on which they perform the distance measurement. An absolute position of the arm can be obtained at all times, which facilitates and improves the precision of the movement of the moving arm.

With the present method, one does away with the use of a total measurement station. The problems related to the installation of such a station are in particular avoided. In particular, such a total measurement station having to deliver an angle measurement relative to a horizontal plane, it must be installed perfectly. This is also why such a total measurement station is never on board a vehicle.

On the contrary, the optical devices according to the present invention are able to determine only a distance measurement. Since they do not need to deliver angle measurements, these optical devices do not need to be kept in a horizontal plane. That is why they can be on board the vehicle 1. Such an optical device delivers a distance measurement with very good precision irrespective of the movements of its support.

Relative to the state of the art, over a cycle that generally takes approximately 90 seconds, this guide method makes it possible to save the 30 seconds necessary for the reorientation of the measurement station and the acquisition of the distance and angle of the other prism.

By shortening the time needed to determine the absolute position of the arm, with equivalent implantation precision, it is possible to increase the implantation rhythm of the tie rods.

Furthermore, the positioning of the prisms in the environment for the building of a portion of the railroad track can be done in parallel to the use of the insertion device to build the preceding portion of the railroad track.

In order to build a portion of railroad track, the prisms placed in the environment only very slightly clutter the worksite. Because their use does not require the intervention of an operator, operator safety is improved.

Of course, the invention is in no way limited to the embodiment described above, and many alternatives can be considered by one skilled in the art.

What is claimed is:

1. A method for guiding an insertion device for inserting elements into the ground for building a structure, comprising:

taking a topographical survey of a plurality of geographical points near the structure to be built, the position of each point being determined in an absolute frame of reference XYZ;

installing a plurality of reflectors, each reflector being placed at a geographical point of the topographical survey;

measuring, using at least three optical devices, fixed on a moving arm of the insertion device that bears the element to be inserted, distances between the reflectors and the optical devices;

computing, by trilateration, an absolute position of the arm of the insertion device from the distances measured and from the known position of each optical reflector; and moving the arm of the insertion device based on the absolute position computed, so as to bring the element to be inserted into a predetermined insertion position.

2. The method according to claim 1, wherein, each optical device tracks a reflector placed in the environment of the insertion device measures the distance between its fixation point on the arm of the insertion device and the reflector associated with it.

3. The method according to claim 2, wherein, an optical device has a limited range and, over the course of the advancement of the structure, new reflectors are installed and associated with each optical device with which the insertion device is provided.

4. The method according to claim 1, wherein the actuation of the arm of the insertion device is done by actuators, controlled by an onboard automaton, which in turn is controlled by a computer, the computer computing the absolute position of the arm from data sent to it, at each moment, by the optical devices with which the insertion device is equipped.

5. The method according to claim 4, wherein said arm is motorized in translation and rotation along three axes orthogonal to one another, the movement of the arm being controlled by the onboard automaton so as to bring the element to be inserted into the absolute implantation position, based on the absolute position of the arm sent to the onboard automaton by the computer.

6. The method according to claim 1, wherein the structure to be built is a railroad track, and the element to be inserted is a tie rod designed to support a rail, the tie rod being inserted into a concrete slab not yet hardened.

7. An insertion device for inserting an element into the ground, designed to be guided by implementing the method according to claim 1, the insertion device including:

an arm, which is motorized in translatable and in rotation along three axes orthogonal to one another, and holds the element to be inserted;

actuators of the arm;

an onboard automaton for controlling the actuators; and a computer for commanding the onboard automaton, wherein the insertion device includes at least three optical devices, fixed on the arm of the insertion device, each optical device measuring a distance between its fixation point on the arm and a remote optical reflector placed at a known installation position in the environment of the structure to be built, and wherein the computer is programmed to compute an absolute position of the arm, by implementing a trilateration algorithm, from measurements sent by the optical devices and the known positions of the optical reflectors.

8. The device according to claim 7, wherein each optical device tracks a target, so as to be able to associate each optical device with an optical reflector placed in the environment.

9. The device according to claim 7, wherein the element is a tie rod designed to support a railroad rail, the tie rod being inserted into a concrete slab not yet hardened.

10. A vehicle, including the insertion device according to claim 7.

11. A vehicle including the insertion device according to claim 8.

12. A vehicle including the insertion device according to claim 9.

* * * * *